United States Patent [19]

Crump

[11] Patent Number: 4,461,506

[45] Date of Patent: Jul. 24, 1984

[54] EQUIPMENT ASSEMBLING, CARRYING AND, OR, SECURING DEVICE

[76] Inventor: John M. Crump, 1018 Parkridge Cir., Jacksonville, Fla. 32211

[21] Appl. No.: 387,962

[22] Filed: Jun. 14, 1982

[51] Int. Cl.[3] ..... A63C 11/02

[52] U.S. Cl. ..... 294/147; 294/163; 294/165

[58] Field of Search ..... 294/142, 143, 146, 147, 294/159, 161–163, 165, 168, 169; 211/60 SK; 224/917; 280/814, 815

[56] References Cited

U.S. PATENT DOCUMENTS

| | | | |
|---|---|---|---|
| 3,307,759 | 3/1967 | Fulton | 294/147 |
| 4,248,365 | 2/1981 | Jacobs | 294/147 X |
| 4,311,333 | 1/1982 | Crump | 294/147 |
| 4,320,918 | 3/1982 | Crump | 294/147 |

*Primary Examiner*—Johnny D. Cherry

[57] ABSTRACT

Improved methods are described for assembling any combination of equipment, such as boots, skis and poles, into releasable assemblage for optionally displaying, merchandizing, storing, carrying, transporting, securing and, or, locking. The arrangements disclosed provide for automatic adjustment to accommodate any size skis, boots and, or, poles resulting from the cooperative relationship between each of the members. The hand grasp has disposed therewith a manipulatable adjustment and securing member snap fastened therewith and including oppositely disposed pivotally mounted boot retainers each snap-in fastened for rotatable motion therewith. The improvement includes an upper pole-lower boot retainer member cooperating with an upper ski-lower pole retainer member both of which are slidably supported on a centrally located column member. The column member may be bipartitely constructed in two halves and snap fastened together with the upper cap and lower ski support retainer members. The adjusting means may be snap fastened onto the handle structure for rotation motion relative thereto.

14 Claims, 17 Drawing Figures

EQUIPMENT ASSEMBLING, CARRYING AND, OR, SECURING DEVICE

TECHNICAL FIELD

The present invention relates to a device for assembling, displaying, merchandizing, storing, carrying, securing, and, or, locking any combination of equipment such as skis, poles and boots, or the like, while simultaneously providing a single, integral means for securing the complete device or any optional combination of equipment when a skier leaves the equipment unattended in a ski resort, public area, or any place where convenience and security are desired for equipment such as skis, poles and boots or the like.

BACKGROUND ART

The prior art, U.S. Pat. No. 4,320,918 for carrying and securing boots, skis and poles wherein the poles are inserted into slots located along the upper portion of a ski retainer member. The poles cooperate with either the boots or the upper boot retainers and depend primary upon the memory of the structural material for retaining force.

Disclosure of Invention

In accordance with the present invention, I provide a method of assembling equipment such as skis, poles and boots, or the like, into a single, integral device having cooperable members for carrying and, or, securing any desired combination of equipment such as skis, boots and poles. The device includes mutually aligned, oppositely disposed, and symmetrically related cooperable retainers, each selectively movable relative to a centrally located column member. My improved device possesses the advantage that the ski and pole retainer members are independently movable parts that may be selectively manipulated into positions conforming to not only the variable boots lengths and ski widths but also to variable pole diameters. The ski and pole retainer members of the present invention provide for automatic adjustment to both the respective pole diameters and ski widths. This feature is of particular advantage and is a distinct improvement over the prior art wherein poles of different diameters may not be securely retained. Formed integral with the upper pole-lower boot retainer member are congrous means having a synergistic result of not only automatically adjusting to varying pole diameters but also providing complete retention along the boot binding lip. Other objects and advantages reside in the construction of the column member and related retainer members for injection plastic molding as will be apparent from the following specifications and the accompanying drawings.

Considering the characteristics of the present invention, there is a centrally disposed column member having a base member disposed at the lower extremity with three equipment retainer units movably engaged and mutually aligned in a predetermined oppositely and symmetrically related relationship to one another and to the column member. Engagement of the retainer units and cooperable parts being selectively accomplished by the characteristic exteriorly telescoping of the two lower retainer units relative to the column member and the interiorly telescoping of the upper retainer unit hand grasp structure in its operative relationship with the interior portion of the column member. Thus the retainer units are respectively engageable with equipment of the character illustrated. The upper boot retainers are pivotally mounted onto the hand grasp structure thereby allowing for interengaging with either the boots or the lower retainer units. Accordingly the cooperating retainer units have a controlled relative relationship which is relatively adjustable and completely versatile so as to accomodate poles, skis and boots of any standard conventional size. The upper retainer unit hand grasp structure is vertically oriented with column member raceway guide means slidably receiving elongated torsion members and adjusting means therein for nonrotation therebetween. The hand grasp structure is removably secured and axially telescoped downwardly into the inner raceway cavities of the column member. The adjusting means is rotatably communicated with securing means disposed interiorly of the column member and manipulatable disposed on the hand grasp structure.

The construction of the column member is uniquely formed for interference interengagement between bipartitely constructed column sections, base member and column cap which are each adapted to allow snap fit final part assembly simply by fitting the two column sections together, telescoping the base down over the column and then placing the cap onto the upper ends of the column sections. It is, therefore, an object of this invention to provide constructions for telescopically assembled and interference snap-fit formed members wherein the members are assembled in a predetermined condition so that the elements are uniquely held in assembled interrelated positions ready for consequential engagement with equipment of the class described. This construction configuration provides unique part geometry whereby all parts can be injection molded in a single family mold without side core pulls or cam action devices. This is a significant distinction when using plastic injection molding tools and dies.

BRIEF DESCRIPTION OF DRAWINGS

These and other detail features of the invention will be best understood and appreciated from the following description of a preferred embodiment thereof selected for purposes of illustration and shown in the accompanying drawings, in which:

FIG. 1 is a perspective view of a device for optionally assembling, transporting, storing, displaying, carrying, securing and, or, locking any combination of boots, skis and poles, or the like.

BEST MODE FOR CARRYING OUT THE INVENTION

Figure 1:
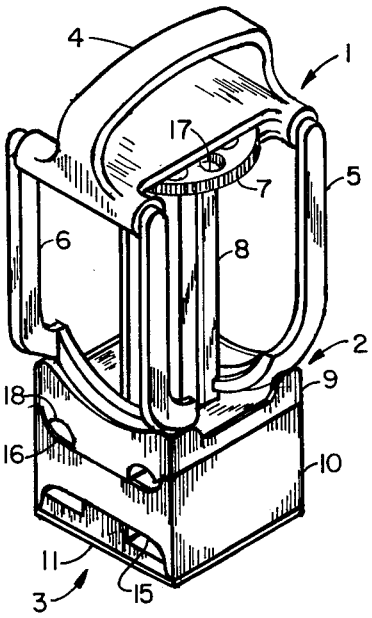

The above brief description as well as further objects, features and advantages of the present invention will be more fully understood by reference to the following detailed description of a presently preferred embodiment in accordance with the present invention, when taken in conjunction with the accompanying drawings, wherein:

FIG. 1 is a perspective view embodying features of the present invention, generally designated by the reference numerals 2 and 3 which includes a cooperative relationship between retainer members 9,10,11,5,6,7 and 8.

Figure 2:
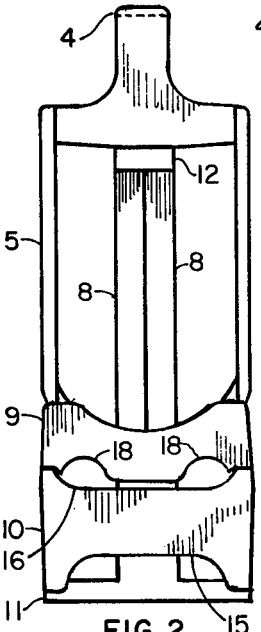
FIG. 2 is an end view of the device shown in FIG. 1 as it may appear without the equipment assembled therewith.
Figure 3:
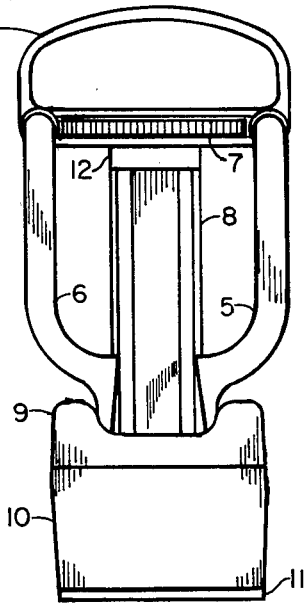
FIG. 3 is a side view of the device shown in FIGS. 1 and 2 as it may appear without equipment assembled therewith.

FIGS. 2 and 3 respectively illustrate this cooperative relationship in end view and side profile. FIGS. 1, 2 and 3 illustrate the present invention without equipment assembled therewith.

Figure 4:
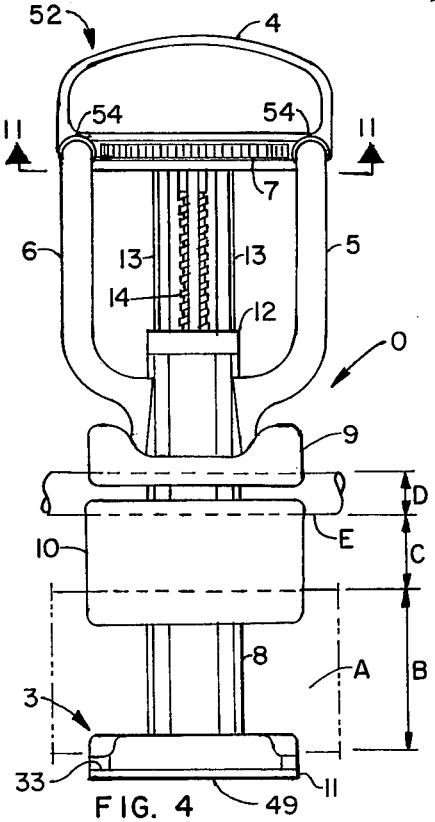
FIG. 4 is a side view of the device shown in FIG. 1 wherein the lower retainer members are in a raised position for retaining skis and poles.

FIG. 4 illustrates one use of the invention wherein skis A and poles E are assembled and separately received into releasable retention by retainer members 9 and 10. Upper ski-lower pole retainer member 10 is generally rectangular in outline and configured to provide a downward clamping action against the top of skis A having height B and to provide a base upon which poles E are supported at a relatively fixed distance C from the top of skis A. Referring to FIGS. 1 and 2 ski retainer member 10 is seen to include ski retainer recess 15 disposed in a cooperative posture relative to base 11 and column 8. At the upper extremity of retainer 10 there are oppositely disposed pole retainer means 16 also in a cooperative posture relative to column 8. Upper pole-lower boot retainer member 9 is seen to include a set of pole retainer means 18 oppositely disposed about column 8 and in a cooperative posture relative to retainer 10 such that poles E are retained in releasable securement together with skis A by means of relative clamping action between parts 9,10 and 11.

Figure 5:
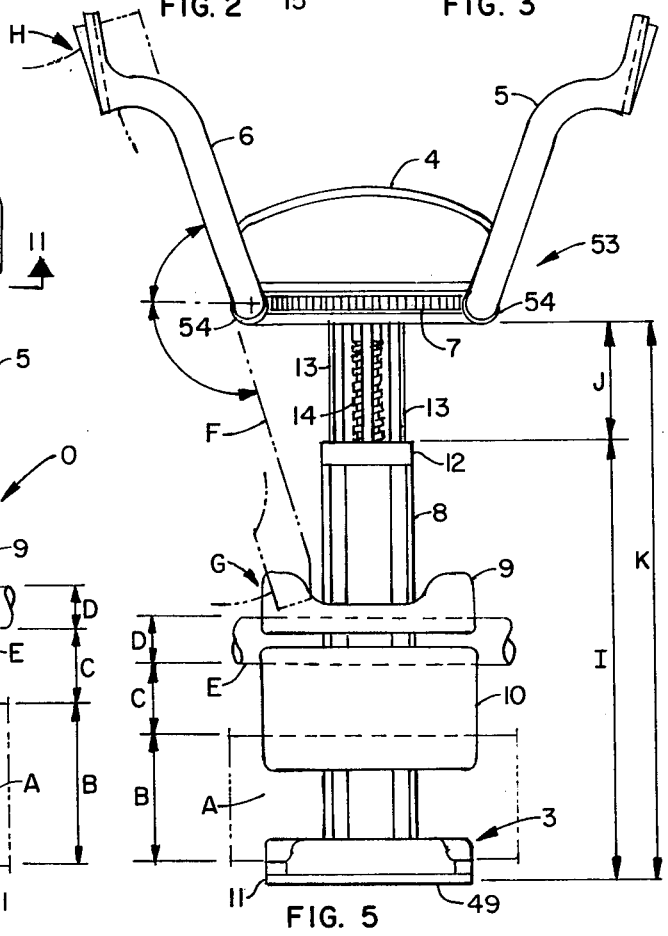
FIG. 5 is a side view of the device shown in FIG. 4 wherein the upper boot retainers are rotated into position for retaining the boots in addition to skis and poles.
Figure 8:
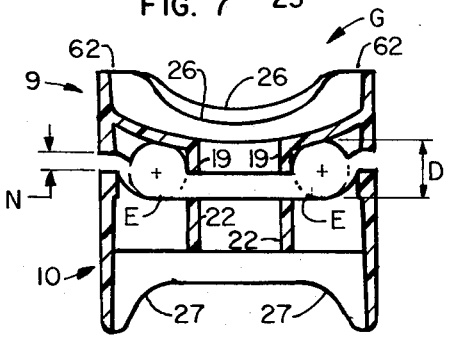
FIG. 8 is a cross sectional view taken on the line 8—8 of FIGS. 6 and 7.
Figure 14:
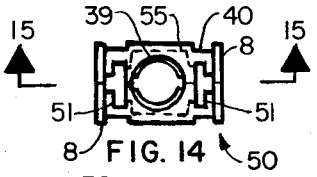
FIG. 14 is a plan view of the column members without the column cap shown in FIG. 12.

Referring now to both FIGS. 4 and 5 observe that retainer members 9 and 10 automatically adjust to accomodate any conventional size skis and, or, poles since members 9 and 10 are slidably engaged with column 8. With the improved relationship between independent but cooperative retainer members 9 and 10 of the present invention all pole sizes D can be efficiently and easily accomodated resulting in a firm secure retention posture under all utilization conditions. This improved pole retention configuration is also illustrated in FIG. 8.

Figure 11:
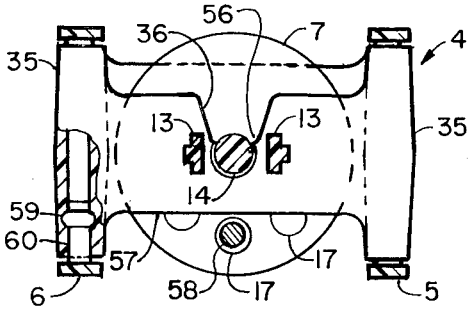
FIG. 11 is a sectional view on the line 11—11 of FIG. 4.
Figure 7:
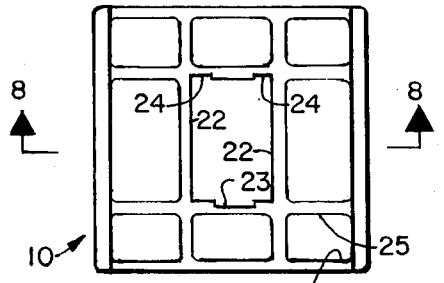
FIG. 7 is a plan view of the upper ski-lower pole retainer member.

As illustrated in FIGS. 4, 5 and 11 adjustment to accomodate equipment sizes, and also to secure the equipment therewith, is achieved by turning adjusting and securing means 7 which is disposed at the upper terminus of adjusting screw 14. Torsion members 13 are slidably guided by column 8 and column cap 12. Upper boot retainers 5 and 6 are rotatably engaged to handle member 4. After the desired equipment combination is positioned, for example, as shown in FIGS. 4 and 5 the adjusting and securing means 7 is rotated until the assemblage of equipment is snug and secure after which a locking means (not shown) may be installed in any one of a plurality of openings 17. Opening 17 is best seen in FIG. 11 which also illustrates that when a cable type locking means 58 for example is installed therein the adjusting means 7 cannot be rotated since sidewall 57 prevents rotation thereby allowing manipulatable securing means 7 to be utilized as an adjusting, securing and locking means.

From the foregoing, it will be seen that there has been provided means for carrying and, or, securing any combination of equipment such as boots, skis and poles or the like, and in use with the parts arranged as shown on the drawings, an assemblage of such equipment A,E and F are adapted to be conveniently carried and, or, secured in the device 1 shown in FIG. 1 which uniquely adjusts to allow the consequential operation of adjusting and securing means 7 to releasable secure any combination of equipment therewith.

From an inspection of FIGS. 4 and 5 it will be recognized that the centrally disposed column member 8 together with base member 11 function as a guiding and supporting structure for members 9,10,13 and 14. In addition base 11 also serves as the lower ski retainer. The bottom 49 of base 11 serves as a platform upon which the entire assembly can be supported, displayed and, or, stored. Lip 33 provides strength and rigidity and also receives the lower side wall of retainer 10.

Figure 15:
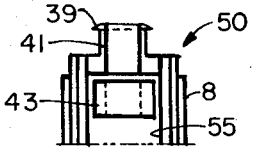
FIG. 15 is a sectional view on line 15—15 of FIG. 14.
Figure 9:
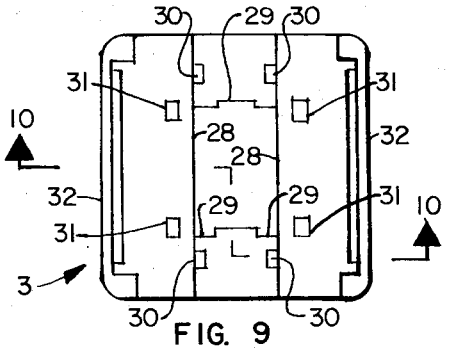
FIG. 9 is a plan view of the base member.
Figure 16:
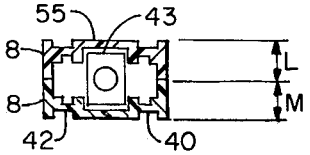
FIG. 16 is a cross sectional view of the column member on line 16—16 of FIG. 17.
Figure 10:
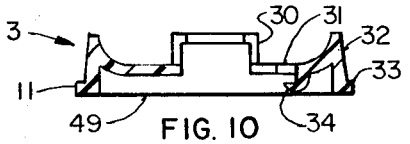
FIG. 10 is a cross sectional view taken on line 10—10 of FIG. 9.
Figure 17:
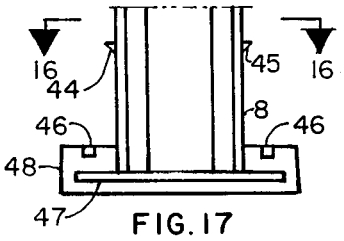
FIG. 17 is partial side view of the column member.

Turning now to FIGS. 6 through 17 it will be seen that the construction features of members 8,9,10,11,12 and 13 are uniquely related to one another thereby providing for not only the boot, ski and pole carrying and securing functional characteristics but also making it entirely feasible to produce each individual member in a multi-cavity mold for plastic injection molding. The base structure 3 shown in plan view of FIG. 9 and cross section view of FIG. 10, is rectangular in outline with ski retainer side walls 32 and a centrally located aperture 28 including raceways 29. The two halves L and M of bipartitely constructed column 8 as shown in FIG. 16 are assembled together as illustrated after which the base structure 3 is axially telescopically received down over the two column sections 8 until the snap fastening means 34 structurally receive base shoulder 47 (FIG. 17) into retention. Simultaneously, the snap fastening means 46 located on the base interlocking structure 48 snap fit into apertures 30 located on base structure 3. Raceways 29 allow base structure 3 to slide pass stop keys 44 and 45. Thus the base structure 3 provides not only for supporting the skis A but also structurally unites the lower terminus of column members 8.

Figure 12:
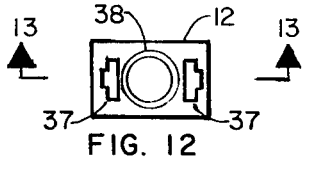
FIG. 12 is a plan view of the column cap.
Figure 13:
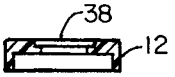
FIG. 13 is a sectional view on the line 13—13 of FIG. 12.

When the two column sections 8 are thus assembled with base structure 3 the column cap 12, shown in FIGS. 12 and 13, can be snap fastened onto the upper terminus 50 of column sections 8. Observe in FIGS. 14 and 15 that when the snap fit means 38 of cap 12 is inserted down over snap fastening means 39 of column members 8 the upper terminus of column members 8 are structurally united as shown in FIGS. 4 and 5. The cross sectional geometry of column members 8, as shown in FIG. 16, is uniquely configured to achieve optimum functional relationships with screw nut 43 and elongated torsion members 13 while also providing a strong, rigid and torsionally stiff column members 8.

As best seen in FIG. 11 the hand grasp structure 4 has two torsion members 13 extending downwardly for telescopic engagement with guide apertures 37 in cap 12. Torsion members 13 continue to telescope downwardly into guide apertures 51 in column members 8. Adjusting screw 14 is also telescopically received into screw aperture 41 of column members 8 as shown in FIG. 15.

Figure 6:
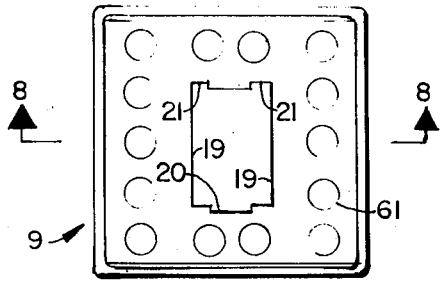
FIG. 6 is a plan view of the upper pole-lower boot retainer member.

Referring to FIG. 6 the openings 61 remove weight and also allow snow and water to drain from the assembly. Raceways 20 and 21 cooperate with stop keys 44 and 45 shown on column members 8 in FIG. 17. In one assembly position upper pole-lower boot retainer member 9 passes clear of these stop keys 44 and 45. When member 9 is rotated 180 degrees and aperture 19 is installed down over column members 8 the stop keys 44 and 45 do not allow member 9 to pass by. A similar description applies to the raceways 23 and 24 shown in FIG. 7 on member 10. The purpose of this feature is best understood by observing the functional relationship of boot sole line F in FIG. 5. Hand grasp structure 4 can be moved downwardly from height K to height I whereupon distance J is zero. Since member 9 retains the boot toe G, and when J is zero, members 9 and 10 can be moved up to stop keys 44 and 45 thereby accomodating extremely short boot soles F without skis A and poles E assembled therewith.

Again more particularly to the principles of the present invention, it can be seen in FIG. 8 that distance N can be varied to accomodate any pole diameter D. It will be noted that with this construction, the normal operation of the device 1, in FIG. 1, assembly 52 in FIG. 4 and assembly 53 in FIG. 5, will not be impaired, and yet, by simply providing members 9 and 10 to function as shown in FIG. 8, any size poles E are automatically releasably secured therewith.

Another feature of this invention shown in FIG. 8 deals with the boot retainer interface surface 26 which is employed as a congruous boot retention means G shown in FIG. 5. While the prior art provides for boot retention it has the disadvantage of being partially cut away because the poles are installed down through the boot interface surface. While the prior art technique would suffice for boot retention and limited pole diameter retention, it has been found more desirable to support and retain the boots continuously along surface 26 and between boot retention side walls 62. Therefore, the improved and unexpected results achieved by the cooperative relationship between retention members 9 and 10 not only provides for any pole diameter D but also continuous congruous boot retention means G.

As indicated clearly in FIGS. 4 and 5 the hand grasp structure 4 has an adjusting means 7 disposed generally at the lower part of hand grasp structure 4 and symmetrical about adjusting screw 14 and torsion members 13 both of which are telescopically received downwardly into column members 8. In general, therefore, the hand grasp 4 moves upward or downward to fit various equipment sizes such as boot soles F, skis A and poles E. The arrangement therefore adapts the device 1 of FIG. 1 for accomodating a wide range of equipment but nevertheless exerting the required retention pressures at H and G in FIG. 5 or at location O in FIG. 4.

It will also be understood and appreciated that the upper boot retainers 5 and 6 are each rotatable at pivotal mounting means 54 and are selectively engageable at boot upper retention means H, when mutually aligned in a predetermined relationship, engagement of said boots being controlled by the position of said retainers 5 and 6. Adjustment and securing means 7 is disposed horizontally and substantially aligned in between the oppositely disposed retainer mounting means 54. FIG. 11 illustrates the pivot, or rotatable, mounting shaft 60 having a nonremovable snap in means 59 located on the terminus of shaft 60 and rotatably engaged with boot retainer mounting structure 35.

Rotatably disposed, centrally located and longitudinally extending from adjustment means 7 is an adjustment screw means 14 that is telescopically received downwardly into column cap 12 and subsequently adjustably engaged to screw nut 43 best seen in FIGS. 15 and 16. Nut 43 is generally rectangular in outline to prevent rotation and configured for being slidably guiding interiorly in column members 8. Nut 43 is thus captured within column members 8 thereby preventing its rotation while allowing it to slide longitudinally within the nut raceway 55.

Equipment Size

The present invention satisfactorily overcomes the pole size variations D by applying the retaining force to an upper perpheral segment of poles E by means of an upper pole-lower boot cooperable engaging part 9. Constructed stationary with part 9 are boot retaining means 26 which releasable engages the boot in accordance with position G in FIG. 5. The improved construction described is particularly suitable to accomodate any size equipment such as ski A, pole E or boot F as best illustrated in FIGS. 4 and 5. Furthermore, a device 1 constructed with the stop keys 44 and 45 shown in FIG. 17 will allow ski and pole retainer members to be rotated 180 degrees relative to column members 8 thereby causing the raceways 21, 23 and 24 not to align with the stop keys 44 and 45. Thus, retainer members 9 and 10 will not be allowed to go all the way down to the base structure 3 which causes boot lower retention means G to be located a distance B plus C plus D above base structure 3 which in turn will allow an extremely short boot sole F to be retained between retention means G and H as best seen in FIG. 5. This feature is useful when short boots F are assembled with device 1 without skis A and poles E. Resilient type flexing materials may be employed to obtain further equipment flexibility.

Column Construction

The improved construction features of column member 8 is of particular interest and can best be described with reference to FIGS. 6 through 17. First, in FIG. 16 observe that bipartite column 8 is comprised of two half sections identified by dimensions L and M. The prior art contemplated an integral hollow type column member which would require a more complicated core-pull type of injection mold in order to mold member 8 from plastic. However, with the construction shown in FIGS. 14,15,16 and 17 the column section 8 may be injection molded in a simple multi cavity mold without core pulls or cam action.

The interior of column member 8 provides guide raceways 51 for telescopically receiving torsion members 13. A larger centrally located raceway 55 allows for the travel of screw nut 43 which is adjustably engaged to adjusting screw 14.

The exterior of column member 8 cooperates with rectangular apertures 19 and 22 of retainer members 9 and 10 respectively thereby allowing members 9 and 10 to be slidably and removably guided along the longitudinal axis of column members 8. With this construction, observe in FIGS. 4 and 5 that members 9 and 10 automatically adjust to any ski width B and pole diameter D. Accordingly, adjusting and securing means 7 may then be adjusted to secure equipment assembled therewith in accordance with assembly 52 or assembly 53.

The lower extremity base interlocking structure 48 and base shoulder 47 cooperates with base structure 3 thereby causing the two column sections 8 to be fastened together by means of snap fastening means 30,34,46 and 47 and rectangular aperture 28 received down over column members 8.

The upper extremity snap fastening means 39 is received into snap fastening means 38 of cap 12 thereby causing the two column sections 8 to be fastened together at the upper extremity in response to the application of oppositely directed forces. Column member 8 serve the multi-function purposes of tension loads, torsion loads, guiding and directing the plurality of cooperable equipment engaging parts 9 and 10.

The exterior surface of column sections 8 are characterized by rigidity ribs 40 and 42 which, in conjunction with the general structural cross section configuration shown in FIG. 16, causes the assembled column sections 8 to be torsionally rigid thereby assuring correct functioning with torsion members 13 located on hand grasp structure 4.

Thus, the broad theory of the present improved technique of carrying and, or, securing any combination of equipment such as skis, boots, and poles is accomplished by providing methods for operating and means for movement of multiple equipment retainers 5,6,9 and 10 relative to central column members 8 thereby establishing a relationship adapted to accomodate any size equipment of the class described including means and methods for positioning, inserting, moving, manipulating and operating the cooperable equipment engaging parts.

Hand Grasp Structure

Observe in FIG. 11 that adjusting screw 14 is received into a releasable receiving slot 36 having snap fastening means 56. Thus, unlike the prior art the improved construction of hand grasp structure 4 provides an efficient and easy technique for initial assembling of adjusting and securing means 7 therewith. Openings 17 in adjusting and securing means 7 are positioned relative to hand grasp structure 4 such that a locking cable 58 can be inserted through opening 17 thereby causing the device 1, in FIG. 1, to be locked since adjusting means 7 cannot be turned because cable 58 comes to rest against side wall 57.

Upper boot retainers 5 and 6 are rotatably engaged to hand grasp structure 4 by means of non-releasable snap fit pivotal means 59 connected to boot retainer shaft 60. This provides a simple, economical and rapid assembly method. Snap-fit 59 allows boot retainers 5 and 6 to be assembled to structure 35 by engaging a molded undercut with snap fit lip 59 which if assembled before the members cool will cause the undercut to shrink relative to snap fit lip 59 thereby producing a nonremovable connection.

Configuration For Injection Molding

It has been pointed out that one of the objects of this invention was to provide construction features uniquely configured to not only satisfy the functional characteristics for the cooperable equipment units and parts of assembly 52 in FIG. 4 and assembly 53 in FIG. 5, but also to provide structural geometry that will allow for injection plastic molding in molds that do not require core pulls, cam action or any other troublesome, complicated, difficult to maintain mold features all of which are well known to the mold tooling industry. Such structures in one form are shown in FIGS. 6 through 17, wherein the cross sectional geometry of each member 4,5,6,7,8,9,10,11,12,13,14 and 43 are specifically and uniquely established for injection molding in a multi-cavity "family type" mold. While this technique of manufacture has been discussed and described it should be understood that the present invention can be made using a variety of other techniques while still retaining the fundamental novel features of the invention. For example, the columns 8, cap 12 and base 3 can be made as one integral unit and could still be made in a "family type" mold with side core pull.

All in all, the features of my improved assembling, storing, transporting, displaying, carrying and, or, securing means brings forth an advancement in the art over prior known devices of this character. The utilization of structural materials such as plastic for working parts combined with individual cooperable part geometry will allow injection molding of all parts in a single multi-cavity mold. It will also be recognized and appreciated that the utility of this invention, particularly the working relationship between ski and pole retainer members 9 and 10, and associated parts thereof, provides enhanced efficiency and a feature having significant importance in providing for the carrying and securing of any desired combination of any size equipment such as boots, skis and poles.

Improved Method and Means for Assembling Equipment

The manner in which skis, boots and poles, or the like, may be assembled and used with device 1 shown in FIG. 1 is, of course, susceptible of many variations. For instance, a plural number of skis, boots and poles belonging to a single family or group may be secured utilizing a single cable locking means 18. In this improved method for assembling any combination of boots, skis and poles of variable boot lengths, ski widths and pole diameters, means and methods are provided having distinct improvements over the known prior art. Observe in FIGS. 1, 4 and 5 that any combination of equipment such as skis, boots and poles may be assembled with device 1 with the consequential assemblage 52 or 53 without skis, or 53 without poles, or 52 without poles, or 52 without skis. Furthermore, the sequence and steps in which the equipment is positioned therewith can be to suit the users needs and desires. These improvements are achieved by the combined relationship of an upper pole-lower boot retainer member cooperating with a lower pole-upper ski retainer member both of which are slidably communicated with a centrally disposed column member.

While there have been shown and described and pointed out the fundamental novel features of the invention, as applied to a preferred embodiment, it will be understood that various omissions and substitutions and changes in the form and detail of the device 1 illustrated in FIG. 1 and in its operation may be made by those skilled in the art, without departing from the spirit of the invention and I therefore claim all of these variations that come within the spirit of the present invention. The present embodiment is, therefore, to be considered as illustrative and not restrictive, the scope of the invention being indicated by the claims rather than by the foregoing description, and all changes which come within the meaning, scope, range and spirit of equivalence of my invention are therefore intended to be embraced therein.

I claim:

1. In combination, a base member having horizontal ski retaining platforms and adapted with a plurality of snap fastening means, first and second elongated column members each adapted with cooperable snap fastening means on the lower terminus corresponding to respective said snap fastening means located on said base member, said base member having a centrally located aperture constructed and arranged to receive said column members therethrough into engagement in response to the application of oppositely directed forces thereto thereby fastening said first and second column member one to the other and said base member to said column members, a column cap member having snap fastening means correspond with respective snap fastening means located on the upper terminus of said first and second column members constructed and arranged to receive said column cap member into engagement in response to the application of oppositely directed forces thereto thereby fastening said first and second column members one to the other, apertures oppositely disposed about a central opening in said column cap member, a hand grasp structure having elongated members telescopically received into said cap apertures, boot retainers pivotally mounted on said hand grasp structure, adjusting means communicating between said hand grasp structure and said column members, ski and pole retainer means movable engaged to said column members, the consequential operation of said combination providing for the assembly of any selective combination of equipment such as skis, poles and boots, or the like, for the optional transporting, storing, displaying, carrying and, or, securing of said equipment.

2. A ski equipment carrier for optionally assembling, displaying, merchandizing, transporting, storing, carrying, securing and, or, locking any selective combination of equipment such as skis, poles and boots, or the like, comprising mutually aligned, oppositely disposed and symetrically related cooperable equipment retaining means each independently movable relative to a centrally located bipartite column member, first of said retaining means having a longitudinal axis extending between a hand grasp means and means telescopically engaged with guiding means disposed interiorly along the longitudinal axis of said column member, the improvement comprising a second of said retaining means telescopically engaged with the exterior longitudinal surface of said column member and further characterized by ski retainer means along the lower portion generally beneath and spacedly away from pole support means along the upper portion, third of said retaining means telescopically engaged with the exterior longitudinal surface of said column member and further characterized by pole retainer means generally beneath and spacedly away from oppositely disposed boot retainer means located congruous therewith, fourth of said retaining means disposed at the lower extremity of said column member and comprising means for supporting and retaining the lower edge of said skis while simultaneously functioning as means for fastening together the two parts of said bipartite column member, said hand grasp means further characterized by oppositely disposed pivotally mounted boot retainers and a manipulatable securing and, or, locking means rotatably disposed generally between said pivotally mounted boot retainers, said securing and, or, locking means adjustably communicated with said column member such that the consequential manipulation provides for any combination of said equipment to be releasably assembled therewith.

3. A ski equipment carrying and securing device comprising cooperable equipment retaining units slidably guided and symmetrically related with respect to a centrally disposed bipartitely constructed column member, first of said units having a hand grasp means with oppositely disposed rotatable boot retention means disposed at the upper extremity of a longitudinally extending axis and telescopically communicating with said centrally disposed column member, manipulatable securing means disposed on said hand grasp means and adjustably communicated with said column member, independently movable ski and pole retaining members each mutually aligned in a predetermined oppositely and symetrically related relationship relative to said column member, said pole retaining member having pole retaining means integrally disposed with boot retaining means thereby providing for complete retention along the boot binding lips while simultaneously providing automatic adjustment for retention of variable pole diameters, said ski retaining member cooperating with a base structure disposed on the lower terminus of said column member, said base structure cooperating with said bipartitely constructed column members such that said column members are fastened together, said retaining units selectively movable one relative to the other for selectively engaging any combination of equipment such as boots, skis and poles into releasable securement therewith.

4. A device for carrying and, or, securing any desired combination of equipment such as skis, poles and boots comprising:

multiple equipment retaining means telescopically engaged with a centrally located bipartitely constructed column means;

means provided with one of said retaining means for releasably securing the lower extremity of said column means and providing lower retaining support for said skis;

means for releasably securing and automatically adjusting to variable widths of said skis and providing retaining support for said poles;

means provided with one of said retaining means for releasable securement with the upper portion of said poles and providing lower retaining support for said boots;

means provided with one of said retaining means for releasably securing any desired combination of said equipment.

5. In combination, oppositely disposed equipment retainer means symetrically related and movably mounted in a mutually aligned relationship relative to a centrally located bipartitely formed column means, said retainer means selectively movable by manipulation of a securing means releasably communication between one of said retaining means and said column means, said securing means rotatably disposed within a snap-in aperture located in a hand grasp structure, one of said retainer means cooperating with a base member for retaining equipment such as skis, one of said retainer means cooperating with said means for retaining skis and simultaneously cooperating with said bipartitely formed column means thereby retaining said column together and further cooperating with said securing means such that the consequential assembling of any selected combination of equipment such as boots, skis and poles causes said equipment to be releasably secured therewith.

6. In an equipment carrying and, or, securing device comprising movable retaining means having oppositely disposed symetrically related boot, ski and pole, or the like, releasable retaining means, each of said retaining means movable relative to one another and to the longitudinal axis of a centrally located bipartitely constructed column means, each of said retainer means removably engaged to said column means whereby said retaining means may be removed and subsequently reengaged with said column means such that means provided on said column means in cooperation with means provided on said retaining means allows said securing device to be adjusted to accomodate extreme variations in said equipment sizes, each of said retaining means cooperating with an adjustable securing means rotatably disposed within a snap-in aperture located on a hand grasp structure whereby said retaining means may be manipulated one relative to the other for selectively engaging any combination of said equipment into releasable securement therewith.

7. An equipment assembling device comprising mutually aligned and selectively manipulatable cooperative retention means, first of said retention means having means for retaining skis, second of said retention means having means for retaining boots and, or, poles, third of said retention means having releasable boot retaining means disposed on a hand grasp structure, said third retention means further characterized by having an adjustable securing means releasably engaged to a centrally located bipartitely formed column member, said column member retained in an assembled position by means of said cooperative retention means, the consequential functioning of said device causes any desired combination of said skis poles and boots to be releasably secured with said device.

8. In a device for assembling, carrying and, or, securing any combination of equipment such as boots, skis and poles, cooperable retention means mutually aligned, oppositely disposed, symetrically related, and selectively movable relative to a centrally located bipartitely column member amalgamated by means of a synergistic functional relationship between said retention means, first of said retention means slidable engaged exteriorly onto the lower extremity of said column means forming a ski support base and simultaneously functioning to amalgamate said bipartitely formed column means, second of said retention means having adjustable securing means disposed with hand grasp means located at one extremity and adjustably engaged with the interior longitudinal axis of said column means, said first and second retention means cooperating with independently movable ski and pole retention means such that the consequential cooperative functioning causes any selected combination of said equipment to be retained in releasable securement therewith.

9. In a method of assembling ski equipment, or the like, with a device for transporting, storing, displaying, carrying, securing and, or, locking said equipment of the type comprising any combination of skis, poles, and boots, the improvement consisting of the selective steps of:

positioning said skis onto ski retaining support means disposed for fastening together the lower terminus of a centrally disposed bipartitely formed column member after which a ski retainer means is moved down into releasable retention therewith;

positioning said poles parallel within oppositely disposed pole support means disposed integral with said ski retainer means after which a pole and, or, boot retainer means is moved down into releasable engagement therewith thereby automatically adjusting to variable width of said skis and variable diameter of said poles;

assembling said boots into releasable engagement with pivotally mounted, symetrically related, mutually aligned boot retention means disposed on a hand grasp means which is manipulatively communicated with said bipartitely formed column member;

optionally removing said ski retainer means from engagement with said column member thereby allowing rotation and reengagement with said column member whereby means on said ski retainer cooperates with means on said column member to allow said device to accomodate extreme variations in said equipment size;

performing an adjustment operation after one or more of the above steps whereby any selective combination of said equipment is retained in releasable securement with said device.

10. In combination, a base member having horizontal ski retaining platform and adapted with a plurality of snap fastening means, first and second elongated column members each adapted with cooperable snap fastening means on the lower terminus corresponding to respective said snap fastening means located on said base member, said base member having a centrally located aperture constructed and arranged to receive said column members therethrough into engagement in response to the application of oppositely directed forces thereto thereby fastening said first and second column members one to the other and said base member to said column members, column cap member having snap fastening means corresponding with respective snap fastening means located on the upper terminus of said first and second column members constructed and arranged to receive said column cap member into engagement in response to the application of oppositely directed forces thereto thereby fastening said first and second column members one to the other, apertures oppositely disposed about a central opening in said column cap member, a hand grasp structure having elongated members telescopically received into said cap apertures, boot retainers pivotally mounted on said hand grasp structure, adjusting means communicating between said hand grasp structure and said column members, ski and pole retainer means movably engaged to said column members, the consequential operation of said combination providing for the assembly of any selective combination of equipment such as skis, poles and boots, or the like, for transporting, storing, displaying, carrying and securing of said equipment, and the consequential construction configuration providing unique part geometry whereby all parts can be injection molded without side core pulls or cam action devices.

11. An equipment carrying mechanism for selectively securing a first, second and, or, third class of equipment such as skis, poles and boots, or any combination thereof, and including a centrally disposed bipartitely constructed column members amalgamated by means of a telescopically received ski base retention means supporting first, second and third movable equipment retention members for respectively receiving first, second and, or, third class of equipment into cooperative engagement therewith, said first retention members adapted for adjustment relative to said ski base retention means, said second retention member movably mounted for adjustment relative to said first retention member, said third retention member disposed integral with a hand grasp means configured for telescopic communication with said column member, manipulatable securing means rotatably disposed within a snap-in aperture disposed with said hand grasp means and adjustably communicating with said column members whereby any combination of said equipment may be releasably secured therewith.

12. A device for carrying and, or, securing any desired combination of equipment such as skis, poles and boots comprising multiple equipment retaining means engaged with a centrally located bipartitely constructed column means and further characterized by a base member axially telescoped over and releasably secured to the lower extremity of said column means thereby releasably engaging said bipartitely constructed column means and simultaneously forming a lower ski retaining means, multiple equipment retaining means slidably and removably guided along the longitudinal axis of said column means thereby cooperating with any combination of said skis, poles and boots for releasable securement therewith, hand grasp means slidably and removably guided for telescopic adjustment and communication with said column means, manipulatable adjusting means disposed with said hand grasp means and adjustably engaged with said column means, boot retention means rotatably engaged with said hand grasp means thereby providing for the releasable securement of any combination of said equipment.

13. An improved adjustable means for selectively holding a first, second and, or, third class of equipment such as skis, poles and boots, or any combination thereof and embodying a centrally disposed bipartitely formed column member having a base means removably interlocking the lower extremity and a cap means removably interlocking the upper extremity, first equipment retention means slidably and removably engaged with said column member and having ski retention means along the lower portion spacedly away from pole support means along the upper portion, second equipment retention means slidably and removably engaged with said column member and having pole retention means along the lower portion spacedly away from boot retention means congruently disposed on the upper portion, hand grasp means telescopically communicating with said column member and having boot retainer means generally symetrically disposed relative to a manipulatable adjusting means associated with said hand grasp means, said equipment retention means cooperating such that the consequential operation causes any selected combination of said equipment to be retained in releasable securement therewith.

14. An improved device for carrying and/or securing any desired combination of equipment such as skis, poles and boots comprising:

first retention means for releasable engagement with oppositely disposed boot heels;

second retention means for releasable engagement with oppositely disposed boot toes and including means spacedly disposed therewith for releasable retention and automatic adjustment to varying pole sizes;

third retention means for releasable engagement with skis and including means spacedly disposed therewith for releasably supporting said poles;

a base member removably interlocking the lower extremity of a centrally disposed bipartitely formed column member;

and securing means releasably engageable to said column member and adjustably disposed on said first retention means.

* * * * *